United States Patent [19]

Brown

[11] Patent Number: 4,793,231

[45] Date of Patent: Dec. 27, 1988

[54] COMPOSITE TOOL AND METHOD OF MAKING

[76] Inventor: Richard H. Brown, 4850 Meadowbrook Rd., Williamsville, N.Y. 14221

[21] Appl. No.: 21,403

[22] Filed: Mar. 4, 1987

[51] Int. Cl.[4] ..... B26F 1/14

[52] U.S. Cl. ..... 83/684; 83/685; 83/686; 83/698; 76/107 R

[58] Field of Search ..... 83/684, 685, 686, 698; 76/107 A, 107 R, 101 B, 101 R, DIG. 5, DIG. 11

[56] References Cited

U.S. PATENT DOCUMENTS

| | | | |
|---|---|---|---|
| 2,150,734 | 3/1939 | Unckel | 76/107 A |
| 2,359,682 | 10/1944 | Ruder | 83/685 |
| 2,544,302 | 3/1951 | Duncan | 76/107 R |
| 2,598,975 | 6/1952 | Coulter . | |
| 3,279,049 | 10/1966 | Ellis et al. . | |
| 3,868,750 | 3/1975 | Ellis et al. | 76/101 R |
| 3,974,727 | 8/1976 | Herlan | 83/686 |

FOREIGN PATENT DOCUMENTS

| | | | |
|---|---|---|---|
| 293457 | 6/1928 | United Kingdom | 76/107 A |

OTHER PUBLICATIONS

Pivot Punch Corporation Catalog, 1958, p. 20.

*Primary Examiner*—Donald R. Schran
*Assistant Examiner*—Scott A. Smith
*Attorney, Agent, or Firm*—Christel, Bean & Linihan

[57] ABSTRACT

Improved composite tools, such as punches and dies, which tools have very high and abrasion resistant working surfaces. The composite tool includes a relatively soft support, such as a tool steel body, and a relatively hard working portion, such as a carbide, which is firmly mounted within the support in such a manner that axial and radial shocks are dampened.

14 Claims, 2 Drawing Sheets

COMPOSITE TOOL AND METHOD OF MAKING

TECHNICAL FIELD

The present invention relates generally to composite tools such as punches and dies or to the method of making them, and more particularly to a punch or die having a harder and more abrasive resilient insert which is bonded to a softer supporting body in such a manner that the tool will have improved resistance to punch shock and lateral displacement, and additionally will require substantially less machining than known prior art.

BACKGROUND OF THE INVENTION

At the present time tools utilizing very hard and abrasion resistant materials are known in the art. For example, carbide punches and dies are known in the art. One form of carbide punches and dies utilizes carbide only. The disadvantage of this form is in the machining costs of carbide which must be ground with a diamond wheel to the final configuration. A further disadvantage of the all carbide punch or die is the basic cost of carbide which runs approximately 5–6 times more than that for tool steel. Thus, not only are all carbide punches and dies difficult to machine, but they are also relatively costly from a material standpoint. In addition the all carbide punches and dies are relatively brittle. This is also generally true for other very hard and abrasion resistant materials.

In order to overcome these disadvantages composite tools have been developed. For example, carbide tipped punches have been developed wherein a carbide extension is brazed or bonded to the leading end of a tool steel support, one such example being shown in FIG. 2, of U.S. Pat. No. 3,279,049. This form of design has proved to be unsatisfactory as the carbide tip has very little lateral stability. Thus, the entire carbide tip can be sheared off at the brazing or bonding line if substantial lateral forces are encountered, which lateral forces are frequently encountered during a punching operation. An example of a composite die is shown in U.S. Pat. No. 2,598,975. In this design the holder (which may be chisel steel) is provided with a tapered counterbore. The insert of harder material (which may be high speed tool steel, Stellite or tungsten carbide) is held within the counterbore by either a force fit or shrink fit. While this design has good lateral stability, it would transmit axial punch shock as the inner end of the insert bears directly against the holder. Additionally, as the sides of the insert through the full length of the bore contact contact the holder it would transmit radial shock.

OBJECTS AND SUMMARY OF THE INVENTION

It is a principal object of the present invention to provide improved composite tools, such as punches and dies which have very hard and abrasion resistant working surfaces, of greater reliability and reduced costs than those presently known.

More specifically, it is an object of the present invention to provide a composite tool formed of a relatively soft support and a relatively hard working portion wherein the shock transmitting portion of the working portion is bound to the relatively soft support by a binding material capable of substantially dampening the shock.

Another object of the present invention to provide an improved composite punch having an insert formed of a very hard material which is mounted in a tool steel body in such a manner that greater shock absorption characteristics are provided, and which, in addition, has greater lateral stability.

It is a further object of the present invention to provide an improved composite die having an insert formed of a very hard material which is mounted in a tool steel body in such a manner that greater shock absorption characteristics and greater lateral stability are provided.

It is a still further object of the present invention to provide a method for making such composite tooling.

The above objects and other objects and advantages of this invention will become more apparent after a consideration of the following detailed description taken in conjunction with the accompanying drawings in which a preferred form of this invention is illustrated.

DETAILED DESCRIPTION

In the various figures, a round punch and round die opening are illustrated. However, it should be apparent to those skilled in the art that other punch and die cross sections may be utilized in the practice of this invention and the round punch and die opening have been shown merely for purposes of illustration. Furthermore, while a punch and die are illustrated, the principles of this invention can be applied to other composite tools, for example slug ejectors, lances and dimplers, etc.

Figure 1:
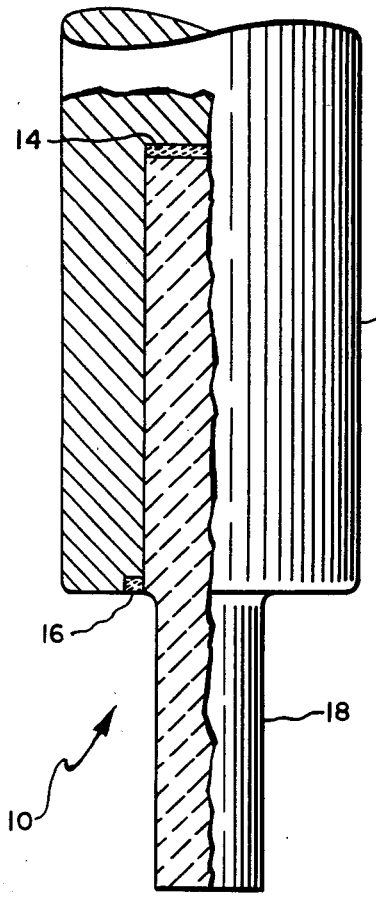
FIG. 1 is a fragmentary side view, partially in section, of a square shoulder punch of this invention.
Figure 3:
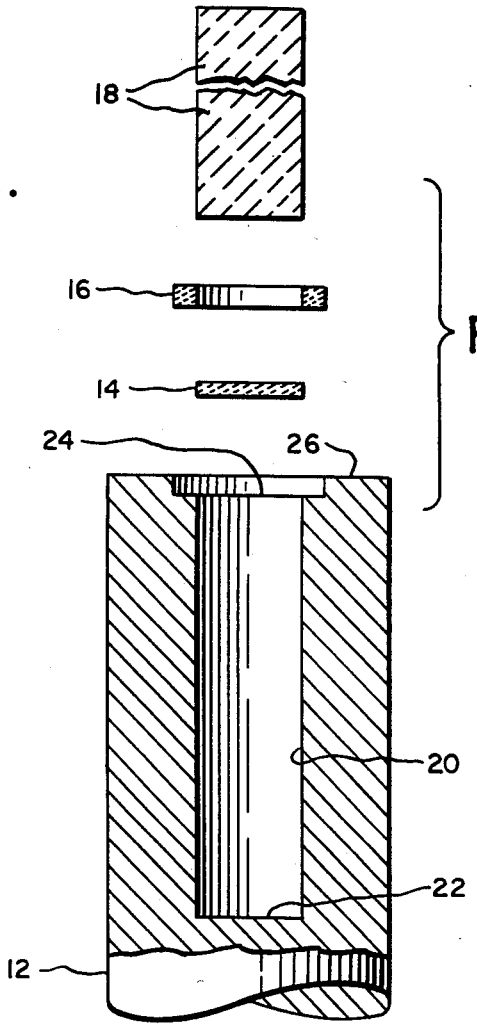
FIG. 3 is an exploded view of the assembly shown in FIG. 1 showing the manner in which the parts are assembled.
Figure 2:
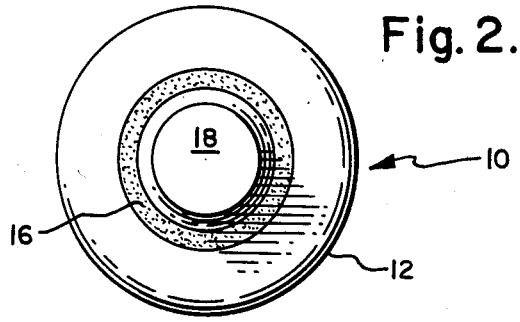
FIG. 2 is an end view of the structure shown in FIG. 1.

Referring in greater detail to FIGS. 1–3, a square shoulder punch made in accordance with this invention is illustrated, the composite punch assembly, shown in FIG. 1, being indicated generally at 10. In the illustrated embodiment, the carbide punch assembly is made from four major components, these being a tool steel punch body 12, a disk shaped solder preform 14, an annular shoulder preform 16, and a carbide insert 18. Only the leading end of the tool steel body is illustrated as the supporting portion of the tool steel body which is associated with the tooling may have many differing shapes depending upon the particular tooling. However, as illustrated, the leading end of the tool steel body is of a generally circular cross section as can best be seen from FIG. 2. The leading end of the tool steel body is initially provided with a suitable insert receiving bore 20 which is reamed out to provide a bottom surface 22 at right angles to the center line of the bore. The diameter of the bore 20 is approximately 0.5 thousandths less than the diameter of the carbide insert 18 to provide an interference fit. The depth of the bore 20 is at least 3 times greater than the initial diameter of the carbide insert, the depth normally being in the range of 3–5 times the diameter of the insert and preferably being 4 times the diameter of the insert. Receiving means in the form of a counterbore 24, which is concentric with the bore 20, is provided on the leading face 26 of the tool steel body.

The disk shaped solder preform has a diameter approximately equal to the diameter of the bore 20. The solder preform 14 is preferably made from a sheet of silver solder by a punching operation. The annular solder preform 16 is of a size such that its outer diameter is the same as that of the diameter of the counterbore 24 and its inner diameter being essentially the same as that of the initial diameter of the carbide insert 18. The annular solder preform 16 is also preferably made by a punching operation from a sheet of silver solder. In this respect, the preform 14 can initially be punched out from a sheet of silver solder and then the preform 16 can be punched out from that material concentric about the portion where preform 14 was punched out. In one preferred form of this invention the carbide insert is made from a C14 carbide material doped with approximately 6% titanium, the titanium giving the carbide insert improved bending strength.

Figure 1A:
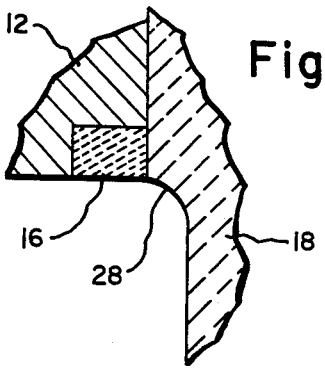
FIG. 1A is an enlarged view of a portion of FIG. 1.

After the various parts 12, 14, 16 and 18 have been formed, they are chemically cleaned to improve their bonding characteristics. The disk shape solder preform is then inserted into the bottom of the bore 22, the preform 16 is inserted into the counterbore 24, and the insert is then inserted all the way to the bottom of the bore until it contacts the preform 14 and further drives it into the bottom of the bore. The parts are then heated to flow the solder preforms to securely bond the insert within the tool steel body 12, the heating preferably being done by induction heating. After the parts have been assembled in the manner described above, it is then only necessary to finish grind the insert 18 to its desired cross sectional area, the grinding being accomplished with conventional diamond grinding wheels. When the insert 18 is ground, it is ground with a curved shoulder 28 (FIG. 1A) for the purposes of stress relief.

By utilizing the solder preform 14 at the upper end of the insert 18 and also by utilizing the solder preform in the counterbore 16 on the face of the tool steel body 12, the material both locks the insert in place and dampens punch shock and additionally absorbs radial shock. More specifically, the disk shaped solder preform absorbs punch shock and the annular insert 16 absorbs radially shock. Thus, as the silver solder 14, 16 is an inert material, in that it has no hardness, it will not transfer vibration. By utilizing the above process and materials to make a punch, material costs are greatly reduced as well as manufacturing time. The punch, after being manufactured in accordance with the process set forth above, can be easily finished with standard diamond grinding wheels working only the areas which need to be finished.

Figure 5:
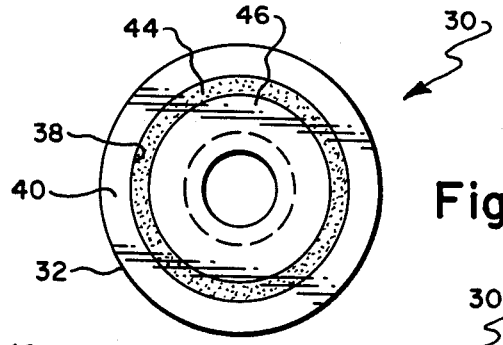
FIG. 5 is an end view of FIG. 4.
Figure 4:
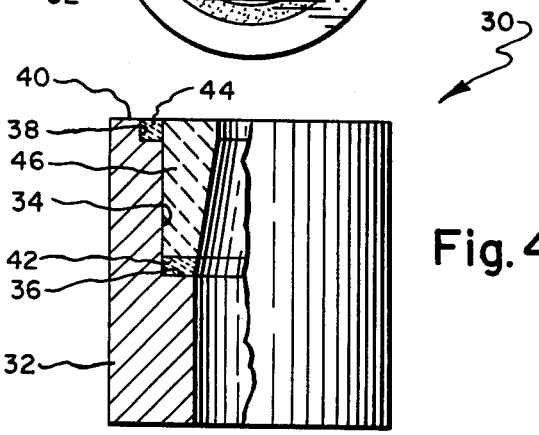
FIG. 4 is a side view, partially in section, of a die made in accordance with the principals of this invention.

The composite die assembly which is indicated generally at 30 in FIGS. 4 and 5 is made by essentially the same process as that described above and has the same characteristics. Thus, the composite die assembly includes a tool steel body 32 provided with a slug receiving bore (no number), an insert receiving bore 34 having a squared out bottom 36 and counterbore 38 adjacent its upper surface 40. First and second annular solder preforms 42, 44 are provided as well as a carbide insert 46. After the parts have been suitable chemically cleaned to improve their bonding characteristics, the first annular preform 42 is inserted into the bore 34 until it abuts the bottom 36, and then the second annular solder preform 44 and the carbide insert 46 are inserted, the parts then being bonded together by a suitable heating process such as induction heating. The die is then finish ground. This die also have very good punch shock resistance characteristics and also is resistant to radial shock.

Figure 6:
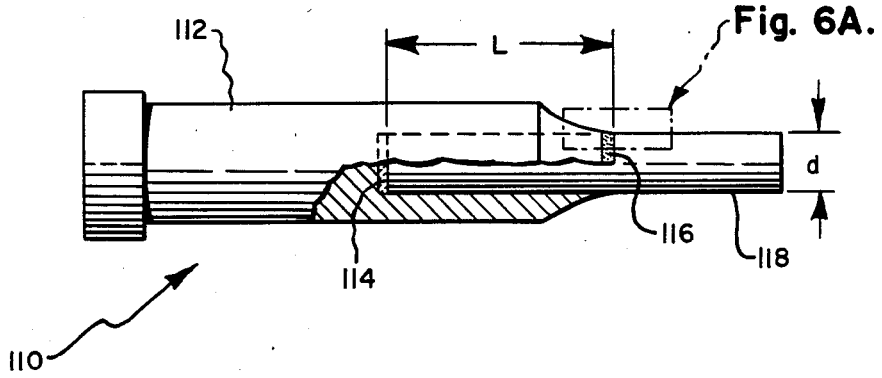
FIG. 6 is a fragmentary side view, partially in section, of a finished radius blend punch of this invention.
Figure 6B:
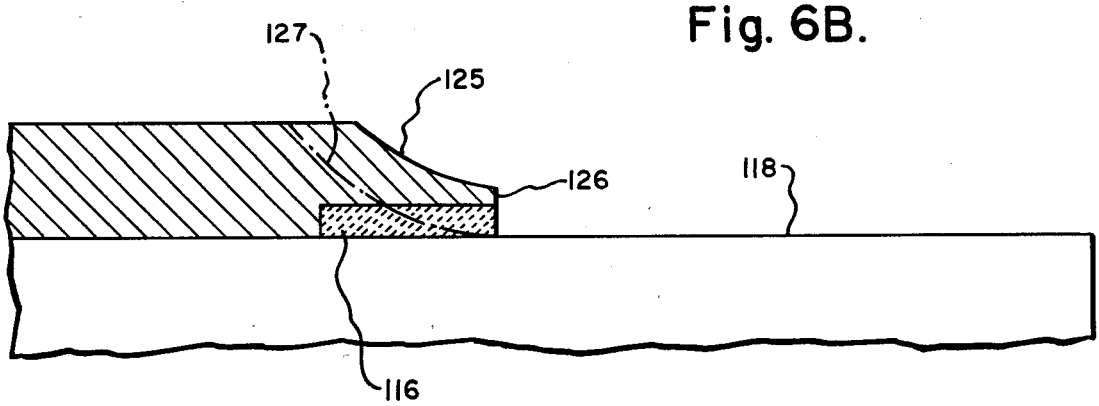
FIG. 6B is a view similar to FIG. 6A showing the radius blend punch prior to finish grinding.
Figure 6A:
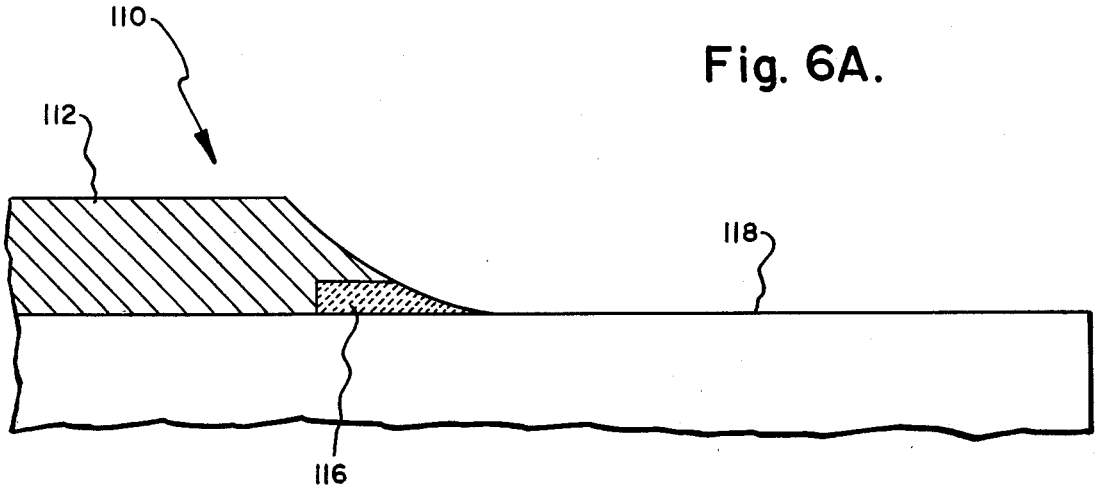
FIG. 6A is an enlarged view of a portion of FIG. 6.

A radius blend punch made in accordance with this invention is illustrated in FIGS. 6–6B, the composite punch assembly, shown in FIG. 6, being indicated generally at 110. This embodiment, like the embodiment illustrated in FIGS. 1–3, is also made from four major components, these being a tool steel punch die 112, a disk shaped solder preform 114, an annular solder preform 116 and a carbide insert 118. The radius blend design of FIG. 6 is made in essentially the same manner as the square shoulder design shown in FIG. 1. Thus, the punch body is initially provided with a bore which is reemed out to provide a bottom surface at right angles to the center line of the bore. The diameter of the bore is so sized with respect to the carbide insert as to provide an interference fit. Also, the depth of the bore is also in the range of 3–5 times the diameter of the insert, preferably being 4 times the diameter. A counterbore is also provided adjacent the leading face of the tool steel body 112 to receive the annular solder preform 116. As can best be seen from FIG. 6B, the annular solder preform 116 is of greater length than that of FIG. 1 due to the finish grinding which will take place, which finish grinding will remove the material between the curved surface 125 and the leading face 126 to the phantom line 127 thus producing the finished design shown in FIG. 6A. Before the finish grinding takes place, the parts are assembled in essentially the same manner as in the punch of FIGS. 1–3. The design of FIGS. 6 also has the same advantages as the composite punch of FIG. 1. Thus, the solder preform 116, after induction heating and cooling, will both lock the insert 118 in place and will also dampen punch shock. Similarly, the solder insert 116, after finish grinding, will also absorb radial shock.

While the insert described above is a carbide, it should be understood that other very hard and abrasion resistant materials can be utilized such as for example boron carbide, sophisticated tool steels, ceramic which may be reinforced with carbon fibers, etc. Similarly, bonding materials other than silver solder may be utilized, it only being necessary that the bonding material is capable of dampening compression vibrations. One such example of an alternate shock absorbing bonding material is the Durobond brand adhesive, distributed to Cotronics Corportion, the Durobond adhesive being an inorganically bonded catalytically cured metallic (aluminum or stainless steel) adhesive. However, the bonding material should be capable of absorbing shocks as well as bonding the insert to the holder.

While preferred structures in which the principles of the present invention have been incorporated are shown and described above, it is to be understood that the invention is not to be limited to the particular details shown and described above, but that, in fact, widely differing means may be employed in the practice of the broader aspects of this invention.

What is claimed is:

1. A composite tool subject to compression shock such as a punch or die, said tool comprising:

a body having an insert receiving bore extending inwardly from an outer surface of one end of the body and receiving means adjacent the bore and the outer surface of said one end of the body, the bore having parallel sidewalls and an inner end surface disposed inwardly of said outer surface, and the receiving means being a counterbore having sidewalls parallel to the sidewalls of the insert receiving bore;

an insert formed of a single material which is harder and more abrasion resistant than the body, the insert having inner and outer ends and parallel sidewalls extending between the ends, the inner end of the insert being disposed within the bore adjacent the inner end surface of the bore, and a first portion of the sidewalls of the insert extending away from the inner end engaging the sidewalls of the bore with an interference fit;

bonding material disposed between the inner end of the insert and the inner end surface of the bore, said bonding material bonding the inner end of the insert to the inner end surface of the bore, said bonding material additionally being capable of dampening compression shock; and additional bonding material disposed within the receiving means, the additional bonding material bonding a second portion of the sidewalls of the insert of the body, said additional bonding material being capable of dampening radial shock.

2. The composite tool as set forth in claim 1 wherein the bonding material is a silver solder.

3. The composite tool as set forth in claim 1 wherein the body is formed of tool steel.

4. The composite tool as set forth in claim 1 wherein the insert is formed of a carbide.

5. A composite punch subject to compression shock, said punch comprising:

a punch body having a punch insert receiving bore extending inwardly from an outer surface of one end of the punch body and receiving means adjacent the bore and the outer surface of said one end of the punch body, the bore having parallel sidewalls and an inner end surface disposed inwardly of said outer surface of the body and the receiving means being a counterbore having sidewalls parallel to the sidewalls of the insert receiving bore;

a punch insert formed of a single material which is harder and more abrasion resistant than the punch body, the punch insert having an inner end, an outer punching end and parallel sidewalls extending between the ends, the inner end of the punch insert being disposed within the bore adjacent the inner end surface of the bore, and a first portion of the sidewalls of the punch insert engaging the sidewalls of the bore with an interference fit;

bonding material disposed between the inner end of the punch insert and the inner end surface of the bore, said bonding material bonding the inner end of the punch insert to the inner end surface of the bore, said bonding material additionally being capable of dampening compression shock; and additional bonding material disposed within said receiving means, the additional bonding material bonding a second portion of the sidewalls of the punch insert to the punch body, said additional bonding material being capable of dampening radial shock.

6. The composite punch as set forth in claim 5 wherein the bonding material is a silver solder.

7. The composite punch as set forth in claim 5 wherein the punch body is formed of tool steel.

8. The composite punch as set forth in claim 5 wherein the punch insert is formed of a carbide.

9. The composite punch as set forth in claim 5 wherein the length of the counterbore is 3–5 times greater than its diameter.

10. The composite punch as set forth in claim 5 wherein the length of the counterbore is approximately four times greater than its diameter.

11. A composite die subject to compression shock, said die comprising:

a die body having a slug receiving bore extending from an outer surface of the body to an opposed surface, a die insert receiving bore extending inwardly from said outer surface and receiving means in the form of a counterbore concentric with the insert receiving bore, the insert receiving bore having parallel sidewalls and an inner end surface disposed inwardly of said outer surface of the body, the counterbore having sidewalls parallel to the sidewalls of the die insert receiving bore, the counterbore being of a greater cross section than the insert receiving bore but of a smaller length;

a die insert formed of a single material which is harder and more abrasion resistant material than the die body, the die insert having inner and outer ends and parallel sidewalls extending between the ends, the inner end of the die insert being disposed within the insert receiving bore adjacent the inner end surface of the insert receiving bore, and a first portion of the sidewalls of the die insert engaging the sidewalls of the insert receiving bore with an interference fit;

bonding material disposed between the inner end of the die insert and the inner end surface of the insert receiving bore, said bonding material bonding the inner end of the die insert to the die body and additionally being capable of dampening compression shock; and additional bonding material received within the counterbore, said additional bonding material bonding a second portion of the sidewalls of the die insert to said one end of the die body and additionally being capable of dampening radial shock.

12. The composite die as set forth in claim 11 wherein the bonding material is a silver solder.

13. The composite die as set forth in claim 11 wherein the die body is a tool steel.

14. The composite die as set forth in claim 11 wherein the die insert is formed of a carbide.

* * * * *